United States Patent [19]

Schachner et al.

[11] 4,272,070

[45] Jun. 9, 1981

[54] COMBINATION WALL MOUNTED DANCE BARRE AND EXERCISE ROD

[75] Inventors: Dianne Schachner; Barbara Zimmerman, both of Potomac, Md.

[73] Assignee: Body Design, Incorporated, Potomac, Md.

[21] Appl. No.: 108,274

[22] Filed: Dec. 28, 1979

[51] Int. Cl.[3] ..... A63B 1/00

[52] U.S. Cl. ..... 272/62

[58] Field of Search ..... 272/62, 63, 109–113, 272/93; 211/105.1, 123, 7, 8, 64; 248/261, 262, 265, 257; 108/137

[56] References Cited

U.S. PATENT DOCUMENTS

| | | | |
|---|---|---|---|
| 515,461 | 2/1894 | Bowen | 272/62 |
| 2,701,425 | 2/1955 | Rewald | 108/137 |
| 2,812,944 | 11/1957 | Finch | 272/62 |
| 3,929,330 | 12/1975 | Cerasoli | 272/63 |
| 4,126,307 | 11/1978 | Stevenson | 272/62 |

FOREIGN PATENT DOCUMENTS

| | | | |
|---|---|---|---|
| 20277 | 10/1955 | Fed. Rep. of Germany | 248/261 |
| 398491 | 1/1909 | France | 272/62 |
| 2296392 | 7/1976 | France | 248/262 |
| 18361 | of 1908 | United Kingdom | 248/265 |
| 25595 | of 1909 | United Kingdom | 248/265 |

*Primary Examiner*—Richard J. Apley

*Attorney, Agent, or Firm*—Wenderoth, Lind & Ponack

[57] ABSTRACT

A combination wall mounted dance barre and exercise rod. A pair of longitudinally spaced supports have mounting plates on one end thereof for mounting the said supports on a wall with the supports projecting laterally from the wall. The supports have grooves adjacent the free ends thereof extending parallel to the direction in which the supports are spaced and a rod is positioned in the grooves. The rod has holes therethrough at least at the positions at which the rod is supported in the grooves on the supports. A quick release bolt is horizontally slidable in each support for movement into and out of the holes for removably holding the rod in the grooves and preventing the rod from rotating about the longitudinal axis thereof relative to the supports. When the rod is mounted on the supports it serves as a dance barre and by moving the bolts out of the holes the rod can be removed from the supports and be used as an exercise rod.

4 Claims, 4 Drawing Figures

COMBINATION WALL MOUNTED DANCE BARRE AND EXERCISE ROD

The present invention relates to a combination wall mounted dance barre and exercise rod, and more particularly to such a combination dance barre and exercise rod which can be mounted on the wall of a room or the like in a fixed nonrotatable position for use in exercises similar to those done by ballet dancers, or can be removed from the wall and used for various exercises utilizing an exercise rod.

BACKGROUND OF THE INVENTION

It is traditional in dance studios to have bars, known as dance barres, mounted along the walls with mirrors behind the bars for enabling ballet dancers to perform special exercises. Recently, exercises have been developed utilizing such bars for persons other than ballet dancers in order to enable them to perform exercises stretching particular muscles and conditioning such muscles which are not conditioned by traditional or free standing exercises. Thus, such dance barres are increasingly being used in exercise rooms for persons other than ballet dancers.

At the same time, exercises are constantly being developed which require the use of a rod to assist the person carrying out the exercise in balancing in relation to the floor or a wall. Such exercise rods are generally about four to five feet long, and have protective tips on the end so that the ends of the rod can be engaged with a wall or the floor in frictional engagement therewith so that the end of the rod will not be damaged and the rod will not slip during the carrying out of the exercise. These exercise rods are normally separate pieces of exercising equipment provided in exercise rooms of establishments which teach and supervise such exercises.

It would be desirable if such exercise rods could also function as barres such as those used by ballet dancers and could be removable so that the person exercising could, when it was desired to use an exercise rod, simply remove the bar from the wall so that it would then serve as the exercise rod.

OBJECTS AND BRIEF SUMMARY OF THE INVENTION

It is an object of the present invention to provide a combination wall mounted dance barre and exercise rod which fulfills the need for such a rod which can be mounted on a wall to serve as a barre, and yet which can be removed from the wall when it is desired to carry out exercises which require an exercise rod.

It is a further object of the present invention to provide such a combination barre and exercise rod which is simple to manufacture and to install, and yet which functions effectively both as a barre when mounted on the wall, and as an exercise rod when removed from the wall mounting.

It is a still further object of the present invention to provide such a combination dance barre and exercise rod which, when it is mounted on the wall is locked against rotation, and yet which can, by a simple movement of a bolt means, be freed from the wall mounting.

These objects are achieved by the combination wall mounted dance barre and exercise rod according to the present invention which comprises a pair of longitudinally spaced support means, means on one end of each support means for mounting the support means on a wall with the support means projecting laterally from the wall, the support means having grooves adjacent the free ends thereof extending parallel to the direction in which the support means are spaced, a rod in said grooves and having holes therethrough at least at the positions at which the rod is supported in the grooves, and a quick release bolt means movable in the support means for movement into and out of the holes in the rod for removably holding the rod in the grooves and preventing the rod from rotating around the longitudinal axis thereof relative to the support means. When the rod is mounted on the support means, it serves as a dance barre, and by moving the bolt means out of the holes in the rod, the rod can be removed from the support means and be used as an exercise rod.

BRIEF DESCRIPTION OF THE FIGURES

The invention will now be described in greater detail in the following specification, with reference to the accompanying Figures, in which.

DETAILED DESCRIPTION OF THE INVENTION

Figure 1:
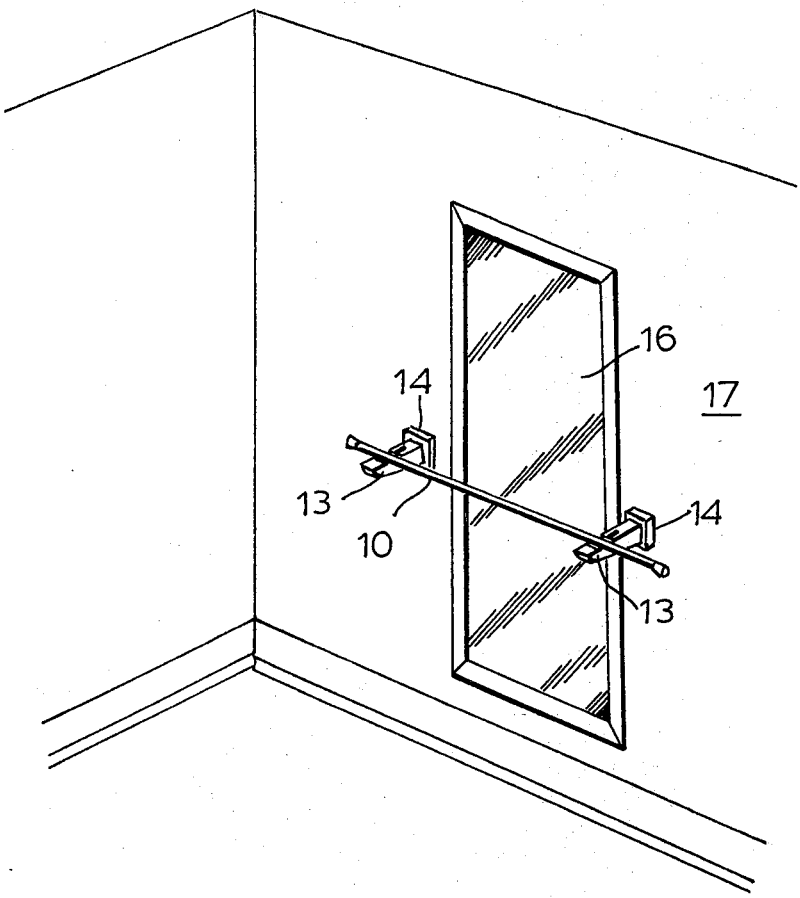
FIG. 1 is a perspective view of the combination wall mounted dance barre and exercise rod according to the present invention mounted on a wall with a mirror therebehind.

As seen in FIG. 1, the combination dance barre and exercise rod is comprised of a pair of longitudinally spaced support means in the form of support brackets 13, each having mounting means in the form of a mounting plate 14 on one end thereof having screws 15 or the like therethrough for mounting the support brackets on a wall 17 with the support brackets projecting laterally from the wall. In the arrangement shown, a mirror 16 is positioned on the wall 17 between the support bracket 13. These support brackets are preferably mounted on the wall at a height above the floor similar to the usual height of a dance barre.

The support brackets each have a groove 18 adjacent the free end thereof, the groove extending parallel to the direction in which the support brackets are spaced from each other. A rod 10 is positioned in the grooves 18 and is removably held in these grooves by a quick release bolt means which will be described hereinafter.

Figure 4:
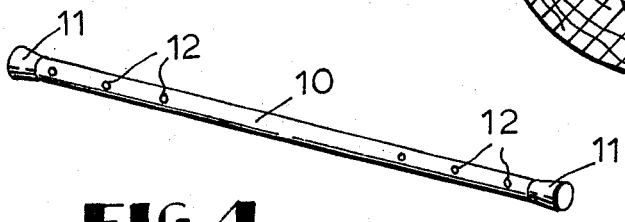
FIG. 4 is a perspective view of the rod.

As seen particularly in FIG. 4, the rod is a simple round rod having tips 11 on the opposite ends thereof made of a protective material which can also engage in frictional engagement with the floor or the wall of the exercise room so that the end of the rod will not change positions once it is pressed against such a floor or wall. There are two groups of holes 12 in the rod 10, one group adjacent each end and spaced along the length of the rod. When the rod is positioned in the grooves 18 in the brackets 13, one hole in each group is aligned with a bore 21 in the bracket. It will be seen that the provision of the groups of holes 12 makes it possible to adjust the positions of the brackets 13 in the direction of the length of the rod 10 to take into account the various widths of the mirror 16, or the location of the studs or the like in the wall 17 to which the mounting plates 14 can be attached.

Figure 2:
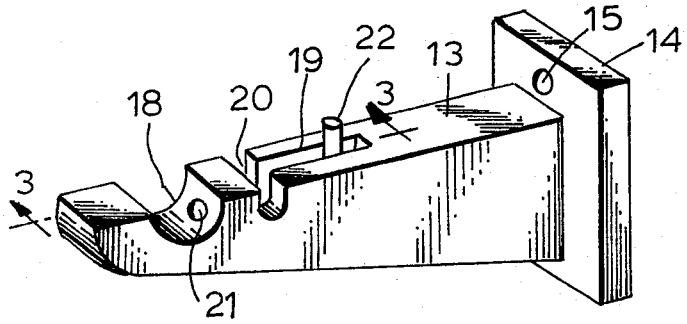
FIG. 2 is a perspective view, on an enlarged scale, of a support bracket for supporting the dance barre and exercise rod.
Figure 3:
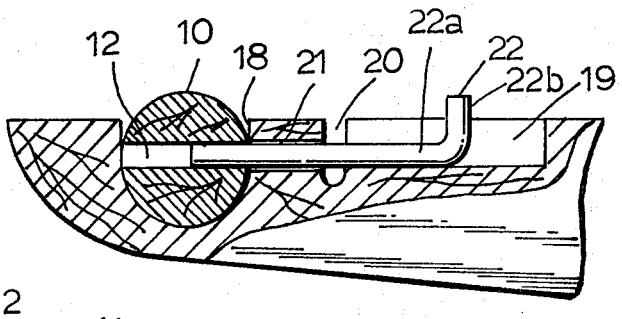
FIG. 3 is a sectional view, on a still larger scale, taken along section line 3—3 in FIG. 2.

As seen in FIGS. 2 and 3, the bore 21 is an extension of a slot 19 which opens out of the top surface of the bracket 13, and has slidably positioned therein the quick release bolt means in the form of a right angle bolt 22. The longitudinal arm 22*a* of the bolt is long enough so that when the rod 10 is positioned in the groove 18, the longitudinal arm 22*a* will extend substantially all the way through the hole 12 in the rod 10. The dimension of the bolt is also such that the transverse arm 22*b*, when the longitudinal arm is all the way through the hole 12 in the rod 10, is adjacent the end of the slot 19 which is closest to the groove 18.

It is preferable that the quick release bolt means have a means for locking the bolt 22 in position with the longitudinal arm 22*a* within the hold 12 in the rod 10. In the present embodiment, this means is in the form of a transverse slot 20 extending across the upper face of the bracket 13 parallel to the groove 18 and substantially the same depth as the longitudinal slot 19.

When the rod 10 is to be used as a dance barre or simply an exercise bar similar to a dance barre, it is mounted in the slots 18 in the brackets 13 with one of the holes 12 in each set aligned with a bore 21 in the corresponding bracket, and the bolts 22 are moved along the longitudinal slots 19 until the longitudinal arms 22*a* are substantially all the way through the holes 12 in the rod 10. The bolts are then rotated around the axis of the longitudinal arms 22*a*, so that the transverse arms 22*b* fall into the slots 20. It will be seen that by extending the slots 20 substantially all the way across the surface of the brackets 13, the bolts can be rotated in either direction around the longitudinal axis of the longitudinal arm 22*a* so that the transverse arms 22*b* can move into the portion of the slots 20 on either side of the longitudinal slots 19.

With the rod 10 thus mounted on the brackets 13, the rod will neither rotate nor come out of the grooves 18. It can therefore be used for exercises similar to those used by ballet dancers.

When it is desired to use the rod 10 as a simple exercise rod, the bolts 22 are operated in the reverse fashion to that described above, thus freeing the rod 10 from the brackets. It can then simply be lifted out of the grooves 18, and it is available for use as a simple exercise rod.

The parts of the device have been shown as being constructed of wood, which is a convenient and readily available material for the parts of the invention. In addition, this is a traditional material for such a dance barre and exercise rod. However, it will be clear to those skilled in the art that the parts can be made of other materials, such as metal or plastic, and have the same shape and appearance as those described above and shown in the drawings.

Also, the various parts such as the brackets can have configurations other than those shown, so long as the grooves 18 are such that the rod 10 is held therein when the bolt means is movable to the position in which it extends into the holes in the rod 10.

The bolt means have been shown as being in grooves 19 and 20 opening out of the top surfaces of the brackets. It will be clear, however, that the grooves could open out of one of the side surfaces of the bracket, and the same effect could be achieved.

Likewise, other bolt means will readily suggest themselves to those skilled in the art, and it is not intended to limit the present invention to the specific bolt means shown.

What is claimed is:

1. A combination wall mounted dance barre and exercise rod, comprising a pair of longitudinally spaced support means, mounting plate means on one end of each support means for mounting said support means on a wall with the support means projecting laterally from the wall, said support means having grooves adjacent the free ends thereof extending parallel to the direction in which the support means are spaced, a rod in said grooves and having holes therethrough at least at the positions at which said rod is supported in said grooves on said support means, and a quick release bolt means horizontally slidable in said support means for movement into and out of said holes for removably holding said rod in said grooves and preventing said rod from rotating about the longitudinal axis thereof relative to said support means, whereby when said rod is mounted on said support means it serves as a dance barre and by moving said bolt means out of said holes in said rod said rod can be removed from said support means and be used as an exercise rod.

2. A dance barre and exercise rod as claimed in claim 1 in which each of said support means is a horizontal support bracket having a longitudinal slot therein and a bore extending from said slot into said groove, and said bolt means is a bolt having a longitudinal arm slidable in said slot and bore and movable into said groove for extending through said rod and a transverse arm projecting out of said slot by which said bolt can be moved in said slot and bore.

3. A dance barre and exercise rod as claimed in claim 2 in which each of said support brackets further has a transverse slot therein intersecting said longitudinal slot at a position at which said transverse arm is positioned when said longitudinal arm extends into a hole in said rod and into which said transverse arm can be turned to hold said bolt in said position.

4. A dance barre and exercise rod as claimed in claim 1 in which there are a plurality of groups of holes, one at a position corresponding to each support means.

* * * * *